US005507715A

United States Patent [19]

Masuno et al.

[11] Patent Number: 5,507,715

[45] Date of Patent: Apr. 16, 1996

[54] DEVICE FOR CLEANING ADHERING MATERIAL OFF OF SAND

[75] Inventors: Osamu Masuno, Mie; Iwao Tomita, Aichi; Kazuharu Matsui, Aichi; Akio Isono, Aichi; Takehiko Matsumoto, Aichi; Tsuyoshi Murata, Fukuoka; Yukinori Aoki, Fukuoka, all of Japan

[73] Assignee: Sintokogio, Ltd., Aichi, Japan

[21] Appl. No.: 310,492

[22] Filed: Sep. 22, 1994

[30] Foreign Application Priority Data

| | | | |
|---|---|---|---|
| Sep. 24, 1993 | [JP] | Japan | 5-261512 |
| Feb. 10, 1994 | [JP] | Japan | 6-037743 |
| Mar. 18, 1994 | [JP] | Japan | 6-074152 |

[51] Int. Cl.[6] ..... B04B 13/00

[52] U.S. Cl. ..... 494/7; 494/51

[58] Field of Search ..... 494/1, 7, 8, 10, 494/43, 50, 51, 55, 60; 210/372, 374, 380.1, 386

[56] References Cited

U.S. PATENT DOCUMENTS

| | | | |
|---|---|---|---|
| 485,475 | 11/1892 | Peck | 494/51 X |
| 873,593 | 12/1907 | Phillips | 494/51 |

FOREIGN PATENT DOCUMENTS

| | | | |
|---|---|---|---|
| 1241210 | 8/1960 | France | 494/50 |
| 81602 | 7/1895 | Germany | 210/372 |
| 63-36848 | 2/1988 | Japan . | |

*Primary Examiner*—Charles E. Cooley

*Attorney, Agent, or Firm*—Limbach & Limbach; W. Patrick Bengtsson

[57] ABSTRACT

A device for removing foreign material from sand is disclosed. The device includes a rotary box which is driven such that sand is centrifuged therein. The box includes a circular bottom plate, a circumferential and inclined wall extending from the circular end of the bottom place, upwardly and outwardly, and ring portion which extends inwardly from the top of the inclined wall. A plurality of rollers are disposed in the box, each roller having a movable surface substantially parallel to and spaced apart from the circumferential and inclined wall of the box. Sand in the rotary box is centrifuged and circumferentially deposited on the inclined wall to form a sand layer which becomes progressively thicker and then contact the movable surface, subjecting the sand to shearing and compressive forces. Processed sand then overflows from the ring portion of the rotary box.

10 Claims, 5 Drawing Sheets

DEVICE FOR CLEANING ADHERING MATERIAL OFF OF SAND

BACKGROUND OF THE INVENTION

1. Field of the Invention

This invention relates to a device for removing adhering material from the surfaces of sand, such as molding sand, etc.

2. Description of the Prior Art

Conventionally, a device for cleaning adhering material off of sand surfaces is used in some technical fields. For example, in the field of producing molds by using molding sand, a device that removes foreign material from sand surfaces to reuse the molding sand is disclosed in the publication JP (Y) 61-35,328. To reuse the sand after it is once used, this device removes or separates the foreign material from sand surfaces by feeding the used sand to an impeller to thereby throw it against a wall. However, since the impact given to the sand is so strong in this method, the sand tends to become fine or smaller. This causes a drawback in that the amount of necessary binding material to be added to the molding sand increases when it is reused.

The purpose of the present invention is to provide a new device for removing foreign material that adheres to sand surfaces while maintaining the original grain size of the sand.

SUMMARY OF THE INVENTION

The device of the invention is provided with a rotary box for removing foreign material that adheres to sand. The rotary box is revolved by a driving means to centrifuge the sand to be processed in the box. The rotary box includes a circular bottom plate, a circumferential and inclined wall extending from time circular end of time bottom plate in a upward and outward direction, and a ring portion which extends inward from the top of the inclined wall. The device includes movable means such as rollers disposed in the rotary box. The movable means has a movable surface which is substantially parallel to and spaced apart from the inclined wall of the rotary box. When the sand in the rotary box is centrifuged and circumferentially deposited on the circumferential and inclined wall of the rotary box a sand layer is formed on the wall. As the box continues to rotate, the sand layer deposited on the inclined wall becomes progressively thicker and then contacts the movable surface, thereby causing the movable surface to move or rotate in the same direction as that of the rotary box. The sand to be processed is pressed between the movable surface and the inclined wall, and it is subjected to a shearing force as well as a compressive three. By the shearing force the foreign material is removed from the surfaces of the sand. The processed sand then overflows, and drops from, the ring portion of the rotary box.

DESCRIPTION OF THE PREFERRED EMBODIMENTS

Figure 1:
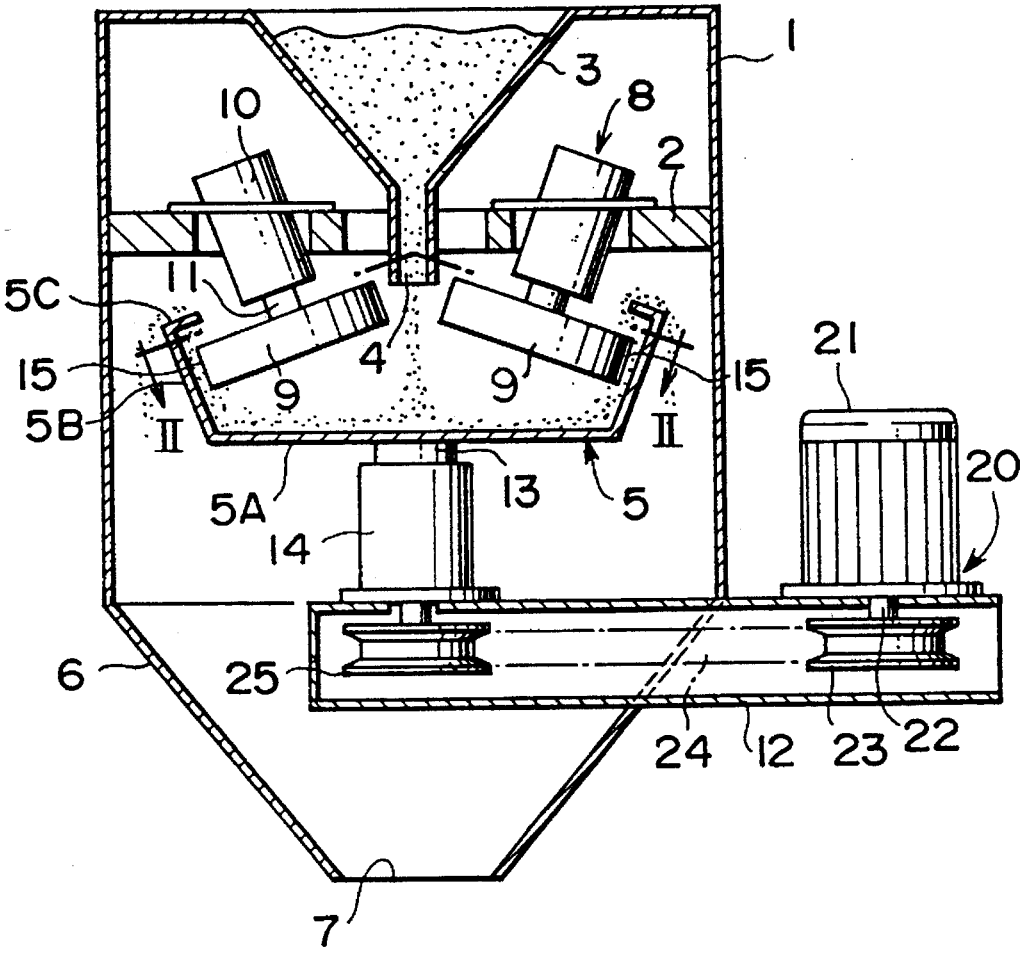
FIG. 1 is a fragmentary sectional front view of an embodiment of the invention.
Figure 2:
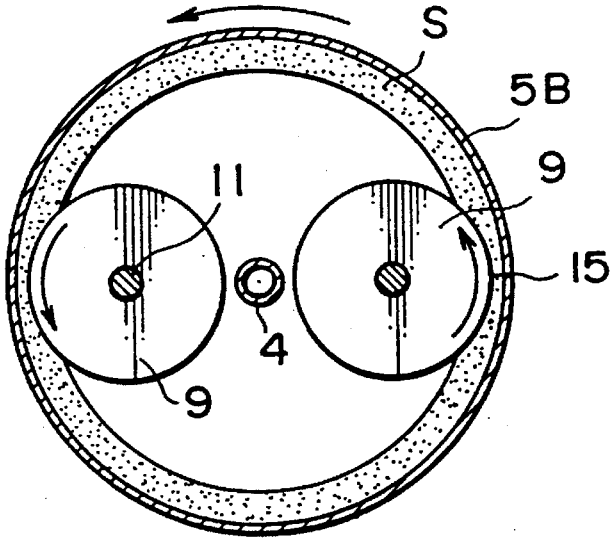
FIG. 2 is a sectional view taken along line II—II in FIG. 1.

In FIGS. 1 and 2 an embodiment of the device of the invention is shown. The device for removing material that adheres to the sand surfaces has a cylindrical housing 1. A frame 2 is mounted on the housing 1 at an upper part. A chute 3 is mounted on the housing at an upper end. A rotary box 5 is disposed in the housing. The chute 3 has a mouth 4 from which the sand to be processed is fed into the rotary box 5. At a lower end the housing has a conical part 6 provided with a discharge port 7. Movable means 8 are mounted on the frame 2. The movable means 8 include a pair of rollers 9, 9. Each roller 9 has a shaft 11 extending in a bearing 10 so that the roller 9 is rotatable in the bearing 10. Thus the surface 15 of the roller 8 is movable.

Another frame 12 is disposed in the housing 1. The frame 12 extends outward from the housing. Driving means 20 are mounted on the frame 12. The driving means 20 include a motor 21, which is mounted on one end of the frame 12, and which has an output shaft 22. The driving means also include a pulley 23 attached to the output shaft 22, a power-transmission belt 24, and a pulley 25 secured to the shaft 13 of the rotary box 5. The shaft 13 is rotatably supported in a bearing 14, which is mounted on the other end of the frame 12.

The rotary box 5 is operatively connected to the driving means 20 such that the box 5 is rotated when the motor 21 operates. The rotary box 5 has a circular bosom plate 5A a circumferential and inclined wall 5B extending from the circular end of the bottom plate in a upward and outward direction, and a ring portion 5C, which extends inward from the top of the inclined wall.

The rollers 9 and the bearings 10 of the movable means 8 are arranged in symmetrical and inclined positions so that the movable surfaces 15 of the movable means 8 are substantially parallel to the circumferential, inclined wall 5B of the rotary box 5. Also, the movable surfaces 15 are spaced apart from the inclined wall 5B. The width of the space between each movable surface 15 and the inclined wall 5B is smaller than that of the ring potion 5C.

The operation of the device will now be explained. The sand to be processed is continuously charged from the chute 3 into the rotary box 5, while the box 5 is rotated by the driving means 20. The rotary box 5 centrifuges the sand to the inside of the inclined wall 5B. The sand is circumferentially deposited as shown by S in FIG. 2. As the operation continues, the sand layer S becomes thicker. When the thickness of the sand layer S exceeds the distance between the movable surface 15 and the inside of the inclined wall 5B, the sand layer 5 contacts the surfaces 15 of the two rollers 9 of the movable means 8. By this frictional contact, the rollers 9 begin to rotate in the same direction as that of the rotary box 5. When the operation continues, the sand layer S becomes thicker, and the sand overflows the ring portion 5C. Thus sand layer S is kept in a constant thickness that is equal to the width of the ring portion 5C.

Under this state, the sand layer S rotates together with the rotary box 5. When a part of the sand layer S comes to the moving surfaces 15, it is pressed between the surfaces 15 and the inclined wall 5B and subjected to both a compressive force and a shearing force. By these forces, the material that adheres to the sand surfaces is removed. The processed sand overflows, and drops from, the ring portion 5C and is discharged from the port 7 of the housing 1.

As the sand is subjected to a shearing force while it is compressed, the material that adheres to the sand is effectively removed. Further, the movable surfaces 15, which are movable in the same direction as that of the rotary box 5, facilitate the sand passing between the movable surfaces 15 and the inclined wall 5B of the rotary box 5. The sand discharged from the port 7 of the housing may be post-treated to be separated into foreign material and sand.

The reason why the circumferential wall 5B is inclined outward is to form the sand layer ring S such that it can be uniform in thickness along the entire height of the ring. If the wall is normal to the horizontal line the inner diameter of the sand layer ring at a lower part would be smaller than that at a higher part due to the influence of gravity. Thus the sand layer is uniformly pressed by movable surfaces.

Although in the drawings two rollers are shown, one, three, or more than three rollers can be used. Further, the movable surfaces may be covered with abrasive material so that they can abrade sand surfaces.

Figure 3:
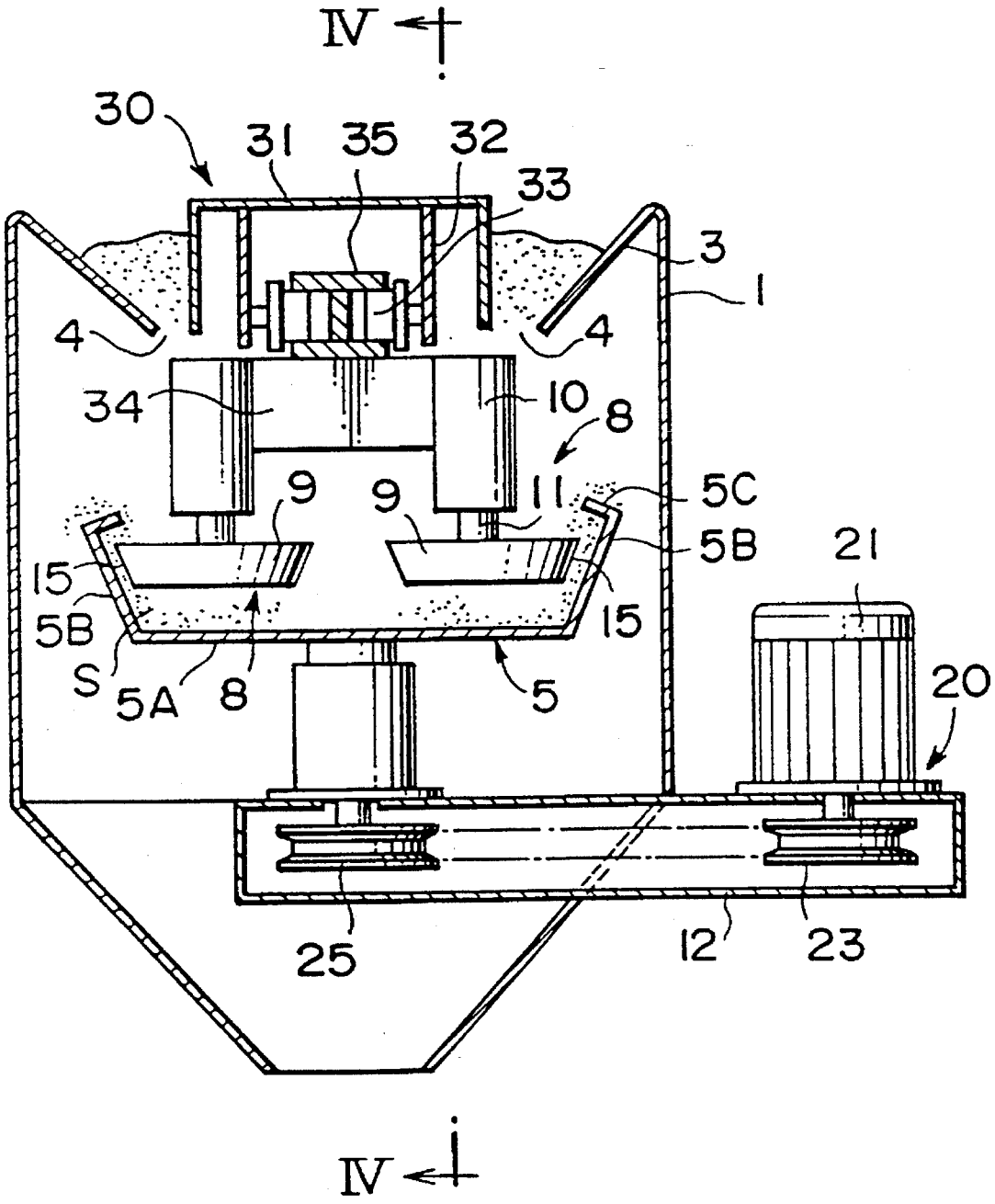
FIG. 3 is a fragmentary sectional front view of an embodiment of the invention.

By reference to FIGS. 3, 4, and 5, a second embodiment of the device will now be explained. This device is similar to that of the first embodiment explained above except for some differences. The first difference is that rollers 9 and bearings 10, of the movable means 8, are arranged in upright positions, and that the rollers each have a tapered surface 15 so that they can be substantially parallel to the inclined wall 5B of the rotary box 5.

The second is that the load ampere to the motor 21 of the means 20 for driving the rotary box 5 can be monitored and kept at a predetermined value. The third is that the device includes means 30 for adjusting the position of the movable means 8 so that the distance between the movable surfaces 15 and the inclined wall 5B is adjusted.

When the movable surfaces are worn after long use, the load to the motor 21 becomes smaller. This results in a decrease in the load ampere to the motor. When the load ampere is lower than a predetermined value, means 30 are used to adjust the distance to a proper one.

A plurality of brackets 32 are secured to a front 1A and a rear wall 1B, of the housing 1. A cover 31 is placed on the brackets. A plurality of guide rollers 33 are rotatably secured to the brackets 32. A rail-shaped member 35 is movably mounted on the guide rollers 33. A nut 36 is secured to the rear wall 1B at the part corresponding to the rail-shaped member 35. A screw 37, which at one end is provided with a handle 38, is threaded with the nut 36. The other end of the screw 37 is rotatably connected to one end of the member 35 through a joint (not shown). The bearings 10 are secured to a transverse bar 34 which, in turn, is fixedly mounted on the member 35.

Figure 4:
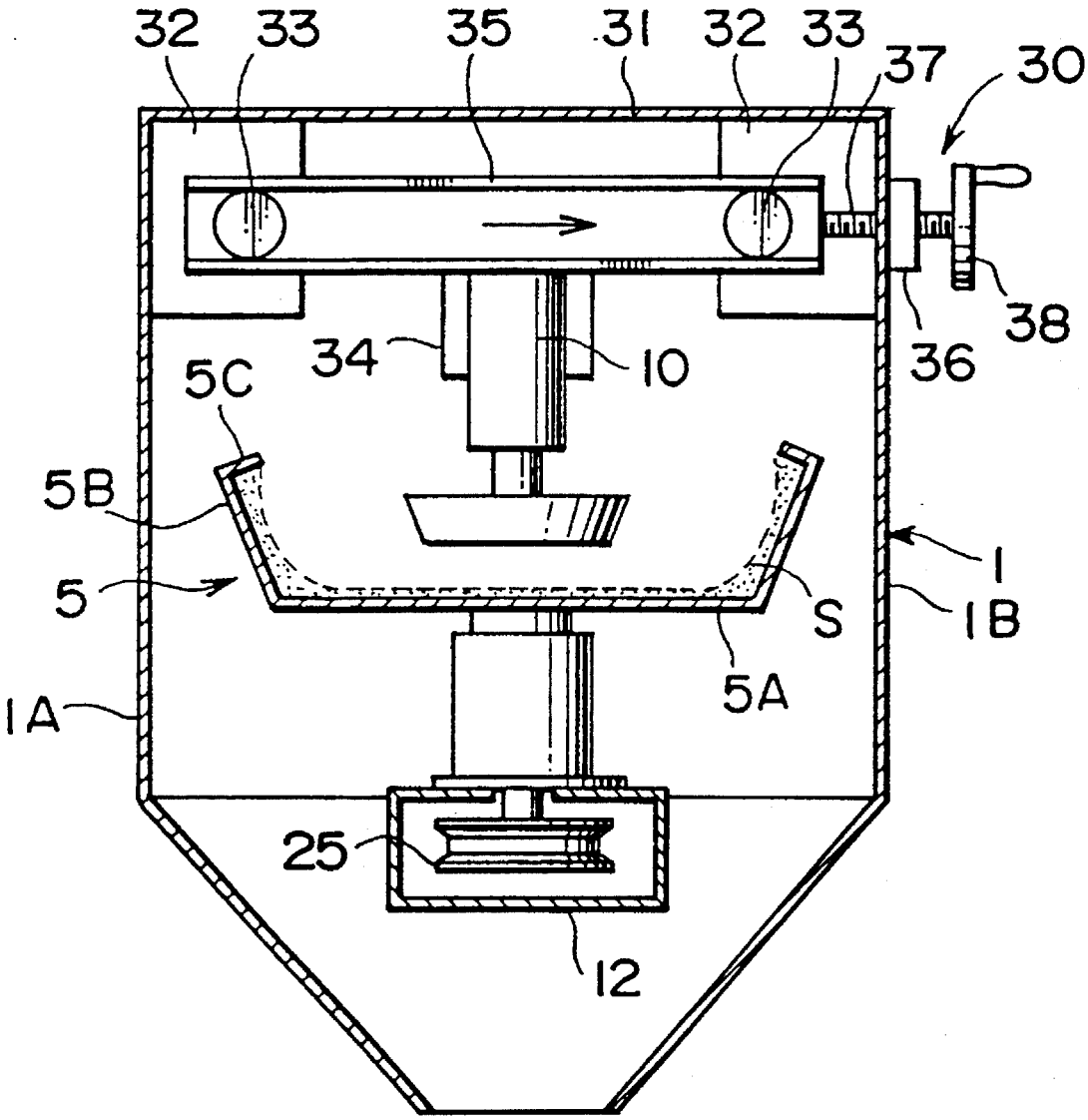
FIG. 4 is a sectional view taken along line IV—IV in FIG. 3.
Figure 5:
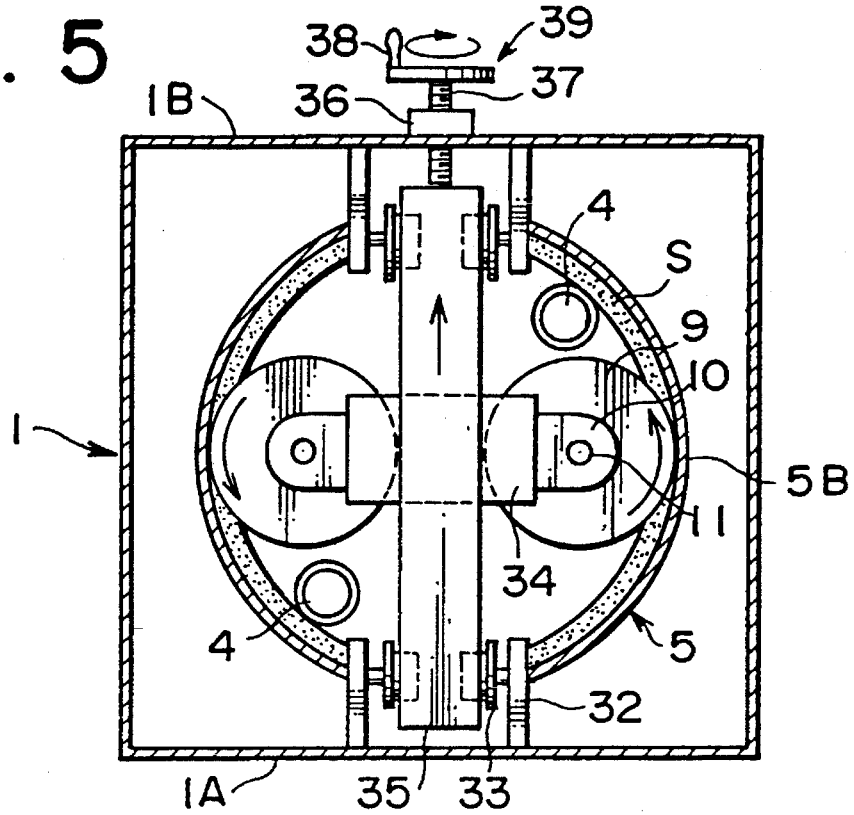
FIG. 5 is a sectional plan view of the embodiment shown in FIG. 3.

By this configuration, when the handle 38 is rotated, the rail-shaped member moves in the direction of the arrow in FIGS. 4 and 5, thereby moving the worn movable surfaces 15 toward the inclined wall 5B of the rotary box 5. Thus the distance is kept at a predetermined value.

In the second embodiment, the rollers can be used for a long time. Further, since the distance is kept constant, the process of removing the foreign material is always uniformly carried out. Although in the drawings only a handle is shown to operate the screw 37 of the position-adjusting means 30, the screw may be operated by a step motor or the like, which cooperates with the motor 21 to drive the rotary box 5.

By reference to FIGS. 6, 7, and 8, a third embodiment will now be explained. This embodiment is similar to the first embodiment. The difference is that the device is provided with means 50 to press the movable surfaces 15 toward the inclined wall 5B of the rotary box 5, under a predetermined pressure.

Figure 6:
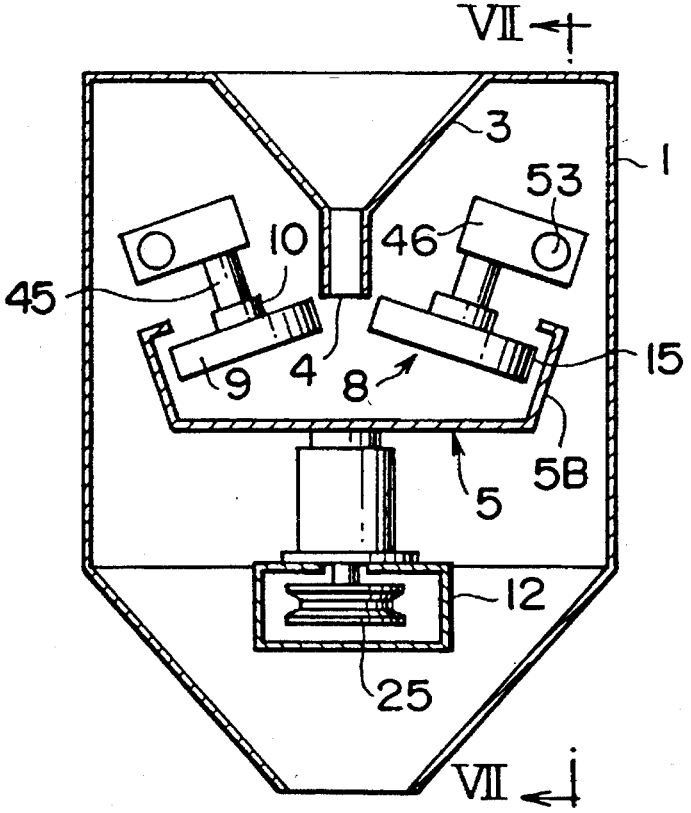
FIG. 6 is a fragmentary sectional front view of an embodiment of the invention.
Figure 7:
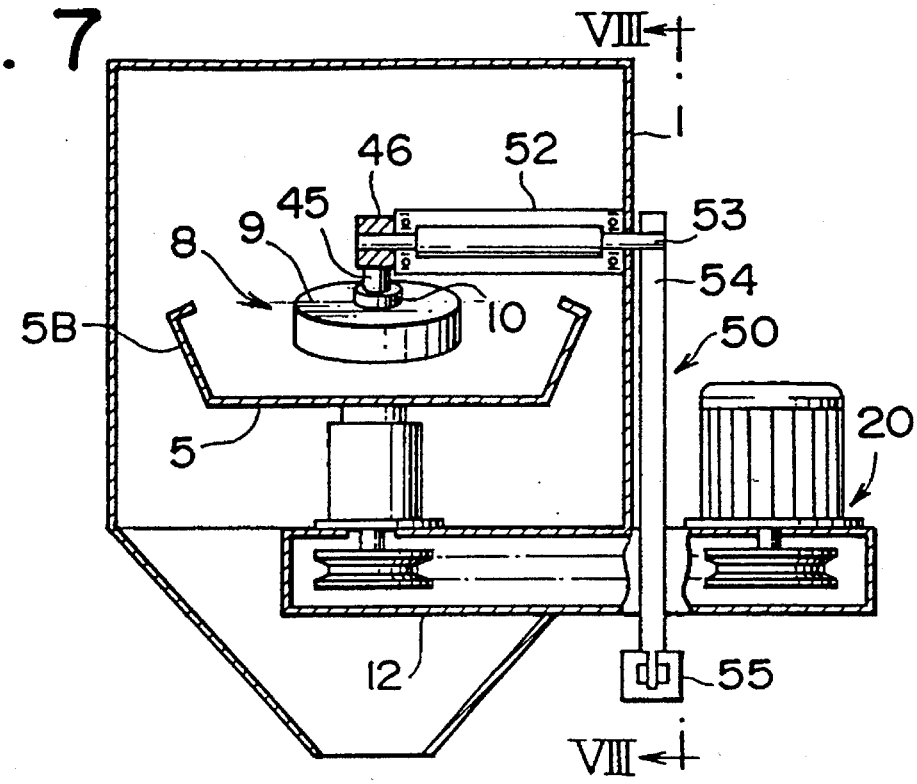
FIG. 7 is a sectional view taken along line VII—VII in FIG. 7.
Figure 8:
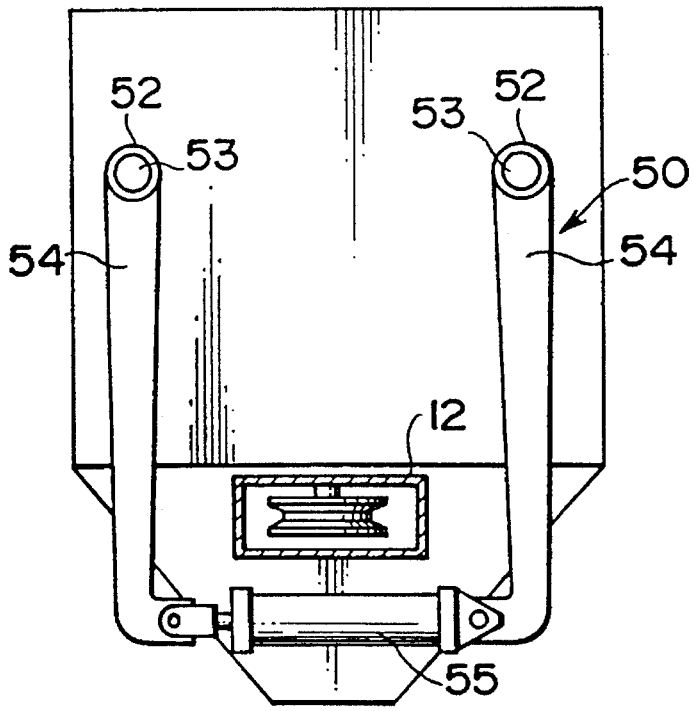
FIG. 8 is a rear view taken along line VIII—VIII in FIG. 7.

As shown in FIGS. 6 and 7, two rollers 9 are rotatably mounted on supports 45 through bearings 10. The supports 45 are secured to ends of arms 46. The other ends of the arms 46 are secured to horizontal shafts 53, 53 of the pressing means 50. The shafts 53, 53 are rotatably disposed in the bearings 52, 52 and extend outward from the housing 1. The pressing means 50 also include rotating arms 54, 54 and a cylinder 55 connected to one end of each of the rotating arms 54, 54. The other end of each rotating arm 54 is fixedly connected to the corresponding shaft 53. Since the cylinder 55 is actuated at a predetermined pressure, the movable surfaces 15 are pressed toward the inclined wall 5B of the rotary box 5.

By this configuration, the sand layer S is always subjected to the same compressive force even if the movable surfaces 15 have been abraded. Instead of the cylinder 55, a compressive coil spring may be used between the rotating arms 54, 54.

One skilled in the art will appreciate that the present invention can be practiced by other than the described embodiments, which are presented for the purposes of illustration and not of limitation, and that the present invention is limited only by the following claims.

What is claimed is:

1. A device for removing adhering materials from the surfaces of sand, comprising;

a rotary box that is horizontally rotatable for removing material from the surfaces of sand, the rotary box including a circular bottom plate, a circumferential and inclined wall extending from the circular end of the bottom plate in an upward and outward direction, and a ring portion which extends inwardly from the top of the inclined wall;

driving means for rotating the rotary box; and a plurality of rollers disposed in the rotary box, each roller having a movable surface that is substantially parallel to and spaced apart from the circumferential and inclined wall of the rotary box so as to press the sand to be processed between the surface and the circumferential and inclined wall.

2. The device of claim 1, the device having a housing, wherein the rotary box and the rollers are mounted on the housing, and wherein above the rotary box a chute for feeding sand to be processed into the rotary box is mounted on the housing.

3. The device of claim 2, wherein a port for discharging the sand processed by the rotary box is disposed at a lower part of the housing.

4. The device of claim 3, wherein each roller is rotatable about an axis substantially parallel to the inclined wall of the rotary box.

5. The device of claim 1, wherein, each roller has an inclined surface substantially parallel to the inclined wall of the rotary box and is rotatable about a vertical axis.

6. The device of claim 1, further comprising means for moving the rollers to adjust a distance between the inclined wall and the surfaces of the rollers.

7. The device of claim 1, wherein the device further comprises means for pressing the movable surfaces of the rollers toward the inclined wall of the rotary box at a predetermined pressure.

8. The device of claim 1 the driving means including a motor, wherein a load ampere of the motor is monitorable.

9. A device for removing adhering materials from the surfaces of sand, comprising;

a rotary box that is horizontally rotatable for removing material from the surfaces of sand, the rotary box including a circular bottom plate, a circumferential and inclined wall extending from the circular end of the bottom plate in an upward and outward direction, and a ring portion which extends inwardly from the top of the inclined wall;

driving means for rotating the rotary box;

movable means having a movable surface, the movable surface being substantially parallel to and spaced a distance apart from the circumferential and inclined wall of the rotary box; and position adjusting means for moving the movable means in a direction to and away from the inclined wall.

10. A device for removing adhering materials from the surfaces of sand, comprising;

a rotary box that is horizontally rotatable for removing material from the surfaces of sand, the rotary box including a circular bottom plate, a circumferential and inclined wall extending from the circular end of the bottom plate in an upward and outward direction, and a ring portion which extends inwardly from the top of the inclined wall;

driving means for rotating the rotary box, said driving means including a motor, the load ampere of said motor being monitorable;

movable means having a movable surface, the movable surface being substantially parallel to and spaced a distance apart from the circumferential and inclined wall of the rotary box;

position adjusting means for moving the movable means in a direction to and away from the inclined wall; and means for adjusting said distance based on the monitored load ampere of said motor.

* * * * *